US005889469A

United States Patent [19]

Mykytiuk et al.

[11] Patent Number: 5,889,469

[45] Date of Patent: Mar. 30, 1999

[54] FAN PULSE ALARM USING TWO STAGE COMPARATOR FOR SPEED DETECTION

[75] Inventors: Basil G. Mykytiuk, Thousand Oaks; Josef Rabinovitz, Tarzana, both of Calif.

[73] Assignee: JMR Electronics, Inc., Chatsworth, Calif.

[21] Appl. No.: 911,385

[22] Filed: Aug. 14, 1997

[51] Int. Cl.[6] ..... G08B 21/00

[52] U.S. Cl. ..... 340/635; 340/641; 340/648; 318/434; 327/18

[58] Field of Search ..... 340/635, 611, 340/648, 584, 626, 641, 530; 364/187, 185, 557; 318/565, 434, 254; 327/72, 77, 18; 361/695

[56] References Cited

U.S. PATENT DOCUMENTS

| | | | |
|---|---|---|---|
| 4,479,115 | 10/1984 | Holzhauer | 340/635 |
| 4,494,055 | 1/1985 | Bitting et al. | 318/254 |
| 4,513,233 | 4/1985 | Giammarrusco | 318/565 |
| 4,843,378 | 6/1989 | Kimura | 340/635 |
| 4,977,375 | 12/1990 | Toth | 340/648 |
| 5,115,225 | 5/1992 | Dao et al. | 340/584 |
| 5,399,911 | 3/1995 | Tarricone et al. | 327/72 |
| 5,434,488 | 7/1995 | Fukuoka | 318/434 |
| 5,436,827 | 7/1995 | Gunn et al. | 364/187 |
| 5,438,226 | 8/1995 | Kuchta | 307/125 |
| 5,517,175 | 5/1996 | Brown et al. | 340/511 |
| 5,534,854 | 7/1996 | Bradbury et al. | 340/635 |
| 5,574,667 | 11/1996 | Dinh et al. | 364/557 |
| 5,727,928 | 3/1998 | Brown | 417/44.11 |

*Primary Examiner*—Jeffrey A. Hofsass
*Assistant Examiner*—Davetta Woods
*Attorney, Agent, or Firm*—Oppenheimer Wolff & Donnelly LLP

[57] ABSTRACT

The alarm circuit uses speed detection so that at a fan slowdown speed below a critical low level, a buzzer alarm starts sounding at a low warning volume and then as the fan slows down further the volume increases; that is, the buzzer volume or the buzzing frequency is inversely proportional to the fan speed. The circuit advantageously can be used for a wide range of fans. A pulse detector of a first stage comparator of this circuit detects the pulses or speed of the fan. More particularly, a power supply isolation resistor with an AC coupling capacitor block the DC voltage levels at the fan so that only the AC or pulse component of the fan is picked up. The isolation resistor prevents the power source from attenuating the pulses. The second stage comparator of the circuit sets the fan speed at which the alarm is to start buzzing and powers the buzzer accordingly. Particularly, the pulses are amplified by the first stage comparator and they periodically discharge a charging capacitor. If the pulses are too infrequent, the capacitor will charge up to the level of an error comparator which will trip and sound a buzzer. Since the circuit uses only discrete components and one (multi-vendor) QUAD comparator for all signal processing including alarm activation, it is inexpensive. It is also very small allowing for greater mounting flexibility.

18 Claims, 3 Drawing Sheets

KD1204PK52
0.3V
210
2.7ms
$V_{1-4}$ $V_{1-2}$
0.4V
214
2.7ms
0V

SLOWDOWN
$V_{1-2}$
218
3.8V
4V
15 ms

KD1205PH53
0.4V
3.6ms
$V_{1-4}$ $V_{1-2}$
4V
3.6ms
0V

SLOWDOWN
$V_{-1}$
3.8V
25ms
0V

KD1206PH52
0.6V
4.2ms
$V_{1-4}$ $V_{1-2}$
3.8V
4.2ms

SLOWDOWN
$V_{1-2}$
20ms
0V

FAN PULSE ALARM USING TWO STAGE COMPARATOR FOR SPEED DETECTION

BACKGROUND OF THE INVENTION

The present invention relates to devices or circuits for monitoring and/or detecting the speed and/or failure of a fan and particularly when the fan is used to cool critical electronic components of a computer.

Many of the prior fan alarm circuit designs attempted to differentiate between running current of the fan and "not running" current. However, this difference is very small when compared with the difference in either current for different sized fans. Thus, a different alarm circuit was required for each size of fan and for fans with different bearings such as sleeve or ball bearing. Additionally, the inherent motor noise pulses required special filtering, because these motor pulses invariably were greater than the difference in running versus none running current. However, using different circuitry is very expensive and requires complicated tracking and logistics to ensure that the proper alarm circuit is installed.

Examples of prior art fan and/or temperature sensors or monitors are shown in U.S. Pat. Nos. 4,479,115 (Holzhauer), 4,843,378 (Kimura), 4,977,375 (Toth), 5,115,225 (Dao et al.), 5,436,827 (Gunn et al.), 5,517,175 (Brown et al.), 5,534,854 (Bradbury et al.), and 5,574,667 (Dinh et al.). (The entire disclosures of each of these patents are hereby incorporated by references.) Many of the prior art alerting systems disclosed in these patents have numerous components resulting in high costs and large units. Since the units are large, the locations where they can be mounted are limited.

One common use for the fans is to cool hard disk drives in computer systems. To efficiently handle larger amounts of data storage, larger hard drives have been and are being developed. These drives turn faster, generating larger amounts of heat. If the cooling fan for that drive slows down too much or otherwise fails, the drives can be damaged if they are not quickly shut-off or the fans quickly replaced. The drives may not spin, errors in data may result and/or they may not acknowledge requests for information. Thus, it is even more critical in today's environment that there be a reliable indication of fan slowdown or failure so that corrective action can be quickly taken to prevent the problems discussed above. Early detection also allows corrective action to be taken before the drives are shut down to prevent or minimize loss of data in progress or other problems caused to open files.

SUMMARY OF THE INVENTION

Directed to remedying the problems in the prior art, an improved fan alarm system and circuit are herein disclosed. A first stage of the circuit accepts fan pulses which exceed a preset limit so as to be insensitive to any noise from the power supply. The pulses are used to reset a voltage charging capacitor. If no fan pulses are received, a charging capacitor charges to a level which exceeds a preset level at a second comparator. This second comparator sets the alarm. When the fan is operating at some slow speed, the charging capacitor can exceed the "alarm level" until the next fan pulse is received. The alarm is then shut off. A low sounding alarm is generated, increasing in volume when the fan slows down more. By setting the "alarm level" to be greater than the capacitor charge voltage generated by the slowest fan operating at one third to one quarter speed, the present circuit allows operation over a wide range of fan speeds.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
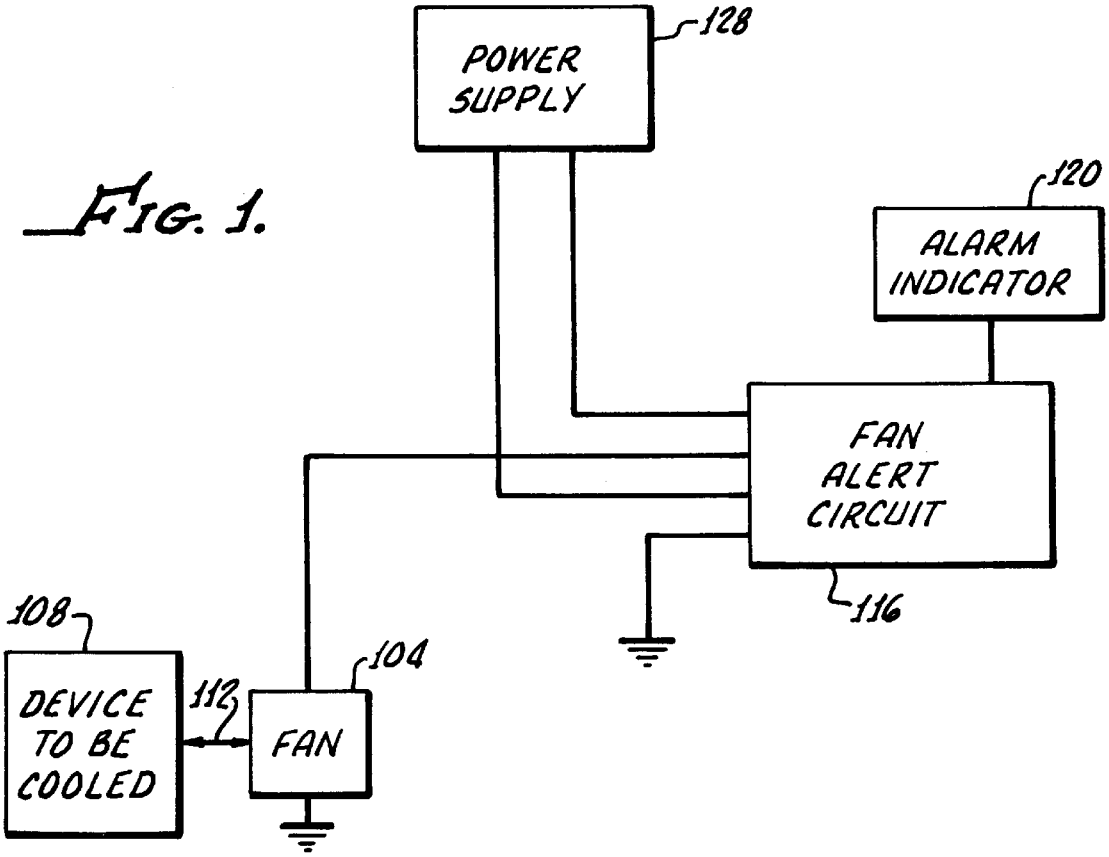
FIG. 1 is a simplified block diagram of a fan alarm system of the present invention.

Referring to FIG. 1, a system of the present invention is shown in block diagram form generally at 100. System 100 includes a fan 104 positioned so as to create airflow 112 for cooling a device 108. The airflow 112 can either be blown towards or exhausted from the device 108. The device 108 pursuant to one preferred embodiment is an electronic component such as a hard disk drive. The fan 104 can be generally any size or type of fan which is presently used to cool such components. In other words, the fan alarm circuit 116 of this invention has the unique advantage that it can accommodate and monitor generally any size fan 104, such as 0.07 to 0.50 amp or forty or sixty to ninety or one hundred and twenty millimeter fans. The construction of the circuit 116 which allows for this flexibility will be described in detail later in this disclosure.

Figure 6:
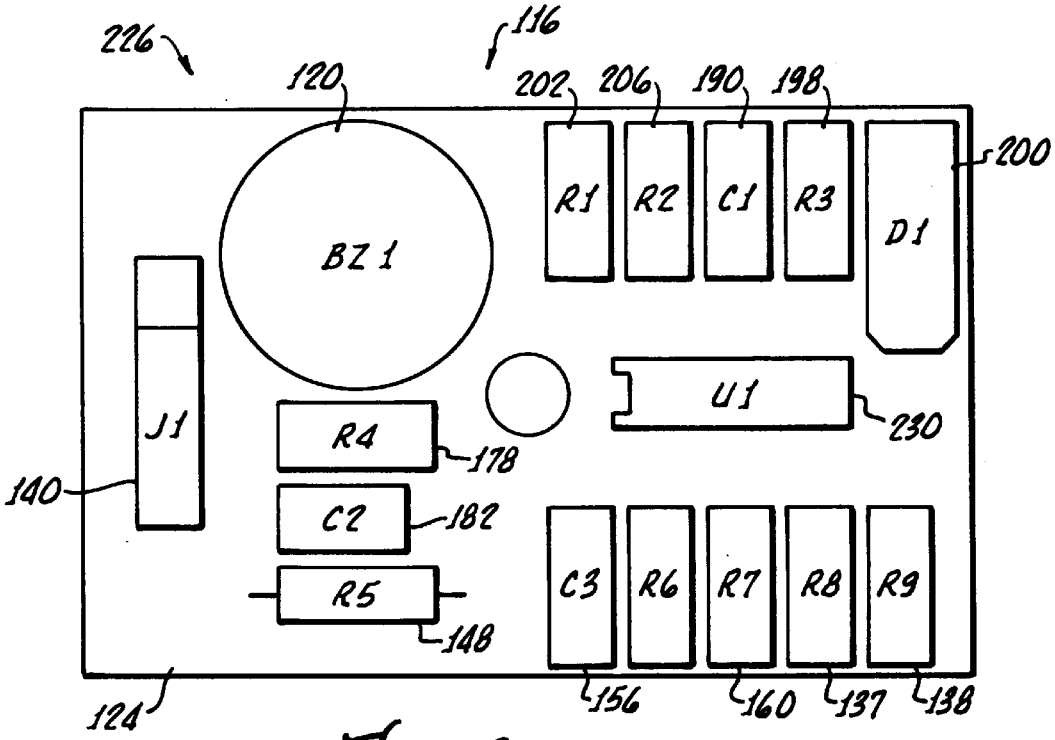
FIG. 6 is a plan view showing the layout of a circuit board implementation of the circuit and buzzer of FIG. 2.

The alarm indicator 120 is a proportional indicator; that is, its signal "strength" is inversely proportional to the speed of the fan 104. The indicator 120 can be an LED indicator, an input into a computer, a display on a computer screen, or preferably an audible buzzer, as will be described in further detail. The indicator 120 will typically be remote from the fan 104 itself, and may be physically located in another room or visible, audible or otherwise detectable in another room. Although the indicator 120 is pictured in FIG. 1 as being physically spaced from the circuit 116, a preferred embodiment, with the indicator being a buzzer, positions the buzzer on the same small board 124 as the circuit 116. This board construction is illustrated in FIG. 6. Additionally, the same power supply 128 that powers the fan 104 also powers the indicator 120 through the circuit 116, as can be understood from FIG. 2. In other words, the fan voltage is used to power the entire circuit 116 so as to minimize the connections to the fan or fans in an enclosure. In essence, this means that the active circuits must operate from ten to fifteen volts DC.

Figure 2:
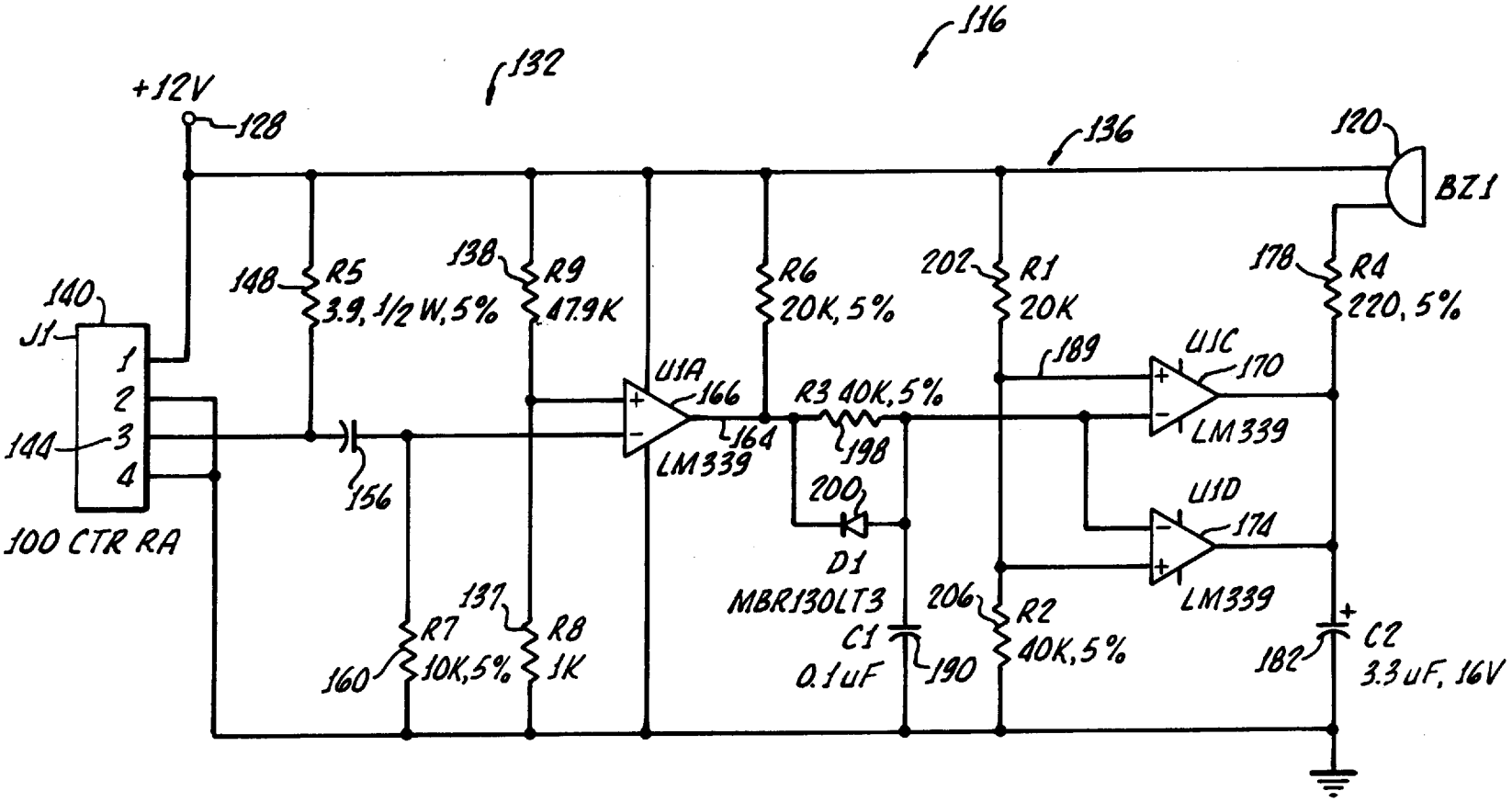
FIG. 2 is a schematic diagram of the fan alert circuit of the system connected to an alarm indicator (buzzer) of FIG. 1.

Referring to FIG. 2, the circuit 116, in addition to having a speed detection, has a two stage comparator construction. The first stage comparator is shown generally at 132, and the second stage comparator is shown generally at 136. The first stage comparator 132 includes resistors 137 and 138 and comparator 166. The second stage comparator 136 includes resistors 202 and 206 and output comparator 170. While the first stage comparator 132 detects the pulses coming from the fan 104, the second stage comparator 136 sets the speed capacitor 190 at a level at which the indicator 120 begins "indicating" and also drives the indicator. The pulses are directly related to motor speed of the fan 104. Since the variation in speed for different sizes of fans is small in comparison to the actual speed, a point range at which the fan alert circuit 116 indicates a "faulty" fan can be established. The fault conditions include the fan 104 not being connected, not turning and turning at a speed which is about one-third of its full rated speed.

Power from the (twelve-volt) power supply 128 is brought into a connector 140 of the circuit 116. The connector 140 also ties the power supply 128 into the fan 104 via isolation resistor 148 and the fan operation into the circuit 116. Pin 144 of the connector 140 is connected to the fan 104. The twelve volts of the power supply 128 pass through the isolation resistor 148 to the fan 104. Thus, as the fan 104 turns it creates a ripple or pulses. If the isolation resistor 148 were not present (or if it had a zero resistance), the circuit 116 would see only the power supply 128 and thus would not see any pulses. In other words, if the power supply 128 were tied directly to the fan 104, then the power supply would filter out the pulses and they would not be seen by the rest of the circuit 116.

The pulses are seen at pin 144 and pass to the input AC coupling capacitor 156. The coupling capacitor 156 acts to block any DC level. This means that it does not matter whether the fan 104 is a five, eight, ten, twelve or twenty-four volt fan. All that it is being picked up is the AC or pulse component of the fan 104. The pulses will be more or less frequent depending on how fast the fan 104 is turning. A return resistor 160 after the coupling capacitor 156 is also provided for the first stage comparator 132.

If the fan 104 stops, nothing passes through the coupling capacitor 156 and the output 164 of the pulse detector comparator 166 would then be and stay high. This causes the output comparators 170, 174, to generate more power for the buzzer 120. For a small buzzer only one comparator is needed, but a preferred buzzer of this invention requires two comparators to supply sufficient power to it, as shown in FIG. 2. (An alternate circuit would be a transistor driver.) The buzzer 120 can be a six to twelve volt buzzer, for example. If a six volt buzzer 120 is used and the power supply 128 is a twelve volt supply then a limiting resistor 178 is placed in the path to limit the current through the buzzer. A noise filter 182 is also provided for the buzzer 120.

Pin 186 into comparator 170 is another reference level. Thus, when the charging capacitor 190 is charged up and exceeds the value at pin 186 it makes the output pin 194 go low, which turns the buzzer 120 on. The charging capacitor 190 gets its charge from charging resistor 198, which charges the charging capacitor and establishes how long it takes for the capacitor to reach the trip point level for the buzzer 120. The diode 200, in turn, allows rapid discharge by bypassing resistor 198.

The charging resistor 198 and the charging capacitor 190 are selected by the designer pursuant to this invention to be the correct size. If they are too large, the charging capacitor 198 will never get charged up enough so that the buzzer 120 comes on. On the other hand, if they are too small, the buzzer 120 will always be going off. A workable pulse range is three to five or six millisecond pulse intervals. Resistors 202 and 206 establish the level that the charging capacitor 190 gets charged to before the buzzer 120 is energized.

Thus, the output comparators 170, 174 have two functions. One is as a comparator to set the point at which the alarm is tripped, and the other is to power or drive the alarm or buzzer.

The circuit 116 works extremely well for fans 120 of sizes from fifty to ninety millimeters. And for the larger one hundred and twenty millimeter fans 120, the isolation resistor 148 can be changed from one-half watt to one watt. However, this larger resistor does not work well for a small fifteen millimeter fan 120, which requires less current and would not necessarily generate as high a pulse. If the threshold level of the pulse detector 166 is reduced to take this into account, a potential resulting problem is that some power supplies are so noisy that the circuit 116 may be fooled into thinking that it is really fan noise. Thus, the designer must factor this in when designing circuits (116) pursuant to this invention for very large and very small fans 104.

Figures 3A, 3B, 3C, 4A, 4B, 4C, 5A, 5B, 5C:
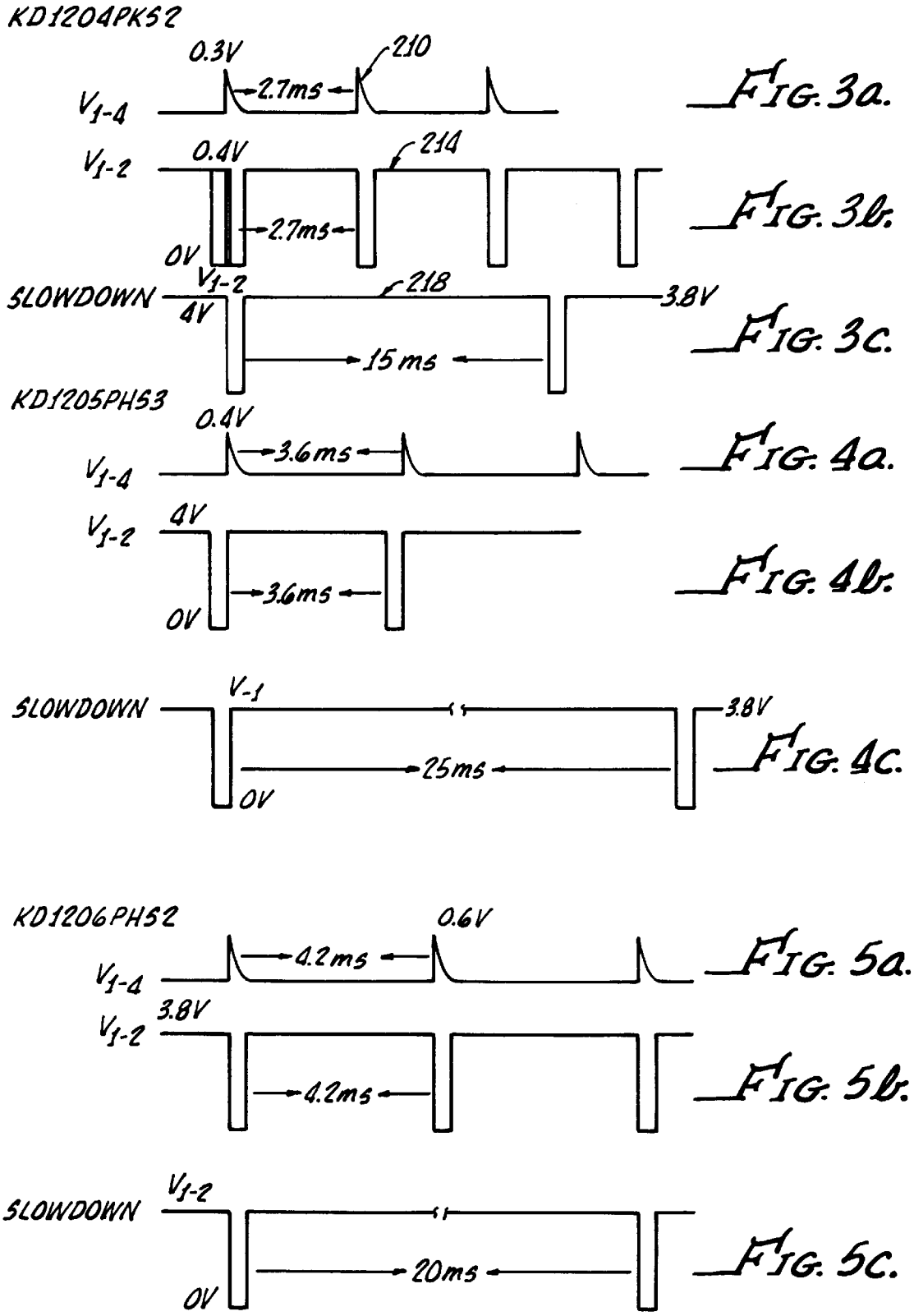
FIGS. 3*a,* 3*b* and 3*c* depict waveforms useful for understanding the operation of the present invention for a forty millimeter fan.
FIGS. 4*a,* 4*b* and 4*c* depict waveforms when a fifty millimeter fan is used.
FIGS. 5*a,* 5*b* and 5*c* depict waveforms for a sixty millimeter fan.

Representative waveforms useful in understanding the present circuit 116 are shown in FIGS. 3*a*, 3*b* and 3*c* generally at 210, 214, 218, respectively, for a forty millimeter fan 104. FIG. 3*a* is a waveform 210 after the coupling capacitor 156. FIG. 3*b* is a waveform 214 at a "normal" running at the output of the pulse detector comparator 166. FIG. 3*c* is a waveform 218 at a "slow down" running at the same location, as by purposely placing a finger on the fan 104 to slow it down significantly. It shows the capacitor discharge pulses, the alarm speed. The pulse intervals stretch out and the charging capacitor 190 will, at a certain level, charge up sufficiently to exceed the trip level established by the output comparator(s) 170 (and 174) and the buzzer 120 will start buzzing. In comparison to a typical prior art system, there are no pulses, just DC levels. So at some point as the fan slows down, the output to the buzzer would start changing in amplitude and no noise (or other indicating signals) would be emitted until the fan was almost stopped.

FIGS. 4, 4*b* and 4*c* show waveforms similar to FIGS. 3*a*, 3*b* and 3*c*, but for a fifty millimeter fan. Likewise, FIGS. 5*a*, 5*b* and 5*c* show waveforms for a sixty millimeter fan.

A board layout of the present circuit 116 and buzzer or indicator 120 is shown in FIG. 6 generally at 226. As can be seen, the size of the board 124 is extremely small—for example, a 0.8 by 1.25 inch board as compared with prior art boards which are typically more than twice as large. It is so small and light that it can be positioned or mounted almost anywhere using self-adhesive clips. Field retrofit is easy, and no modifications to the sheet metal enclosures need to be made. No holes need to be drilled into the chassis. The board 124 can be clipped into any small place. It can easily mount to the side of small (sixty millimeter by twenty millimeter) fans. The board 124 can even be packaged within the confines of various front panel plastic bezels. This small board size provides greater mounting flexibility and use in applications where space is at a premium than was previously possible.

Also, as can be appreciated from FIG. 6, the circuit 116 uses only discrete components and one standard simple integrated circuit, e.g., resistors, capacitors and diodes, and one multi-vendor QUAD (even though only three amplifiers are shown in FIG. 2, so there is a spare amplifier) comparator 230 for all signals processing including alarm activation. That is, the circuit 116 uses an inexpensive common chip along with several non-precision discrete parts, such as ceramic capacitors and five-percent resistors. In addition to providing for the use of a very small board 124, the use of only these components also means that the construction of the circuit 116 is very inexpensive.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A fan slowdown indicator circuit, comprising:

a first stage comparator including a pulse detector for detecting a level of pulses from a fan, wherein said first stage comparator monitors back pulses of a turning DC motor of a fan using a pulsed isolation resistor, an input AC coupling capacitor and a pulse detector comparator; and a second stage comparator including setting means for setting the pulse from the fan at which an indicator indicates a slow pulse rate of the fan and which actuates the indicator, wherein said second stage comparator causes the indicator to have an indicator signal whose size is inversely proportional to the speed of the fan.

2. The circuit of claim 1 wherein said pulsed isolation resistor prevents a power supply, which supplies power to said first and second comparators and the fan, from filtering out the pulses from the fan, said input AC coupling capacitor blocks any DC level of the pulses, and said pulse detector comparator causes additional power to be generated through said second stage comparator to actuate the indicator when a slow pulse rate of the fan is detected.

3. The circuit of claim 1 wherein said second stage comparator includes a charging capacitor and an error comparator operatively connected to said charging capacitor and causing it to actuate the indicator when a low pulse level is reached.

4. The circuit of claim 1 wherein said first stage comparator includes a pulse isolation resistor between a power supply voltage of the circuit and the fan.

5. The circuit of claim 1 wherein said second stage comparator includes a charging capacitor and a charging resistor for charging said charging capacitor.

6. The circuit of claim 1 wherein said second stage comparator includes comparators for powering the indicator.

7. The circuit of claim 1 wherein said first stage comparator AC couples pulses from the fan and then amplifies them.

8. The circuit of claim 1 wherein the indicator is a buzzer and the signal is an audible buzzer noise.

9. The circuit of claim 1 wherein the indicator is an LED, or signal level to a remote monitor.

10. The circuit of claim 8 wherein the remote monitor is a personal computer.

11. The circuit of claim 1 wherein said pulsed isolation resistor of said first stage comparator is located between the fan and a power supply of the circuit and the fan.

12. The circuit of claim 1 wherein said setting means sets the pulse as received from said pulse detector.

13. The circuit of claim 1 wherein said first stage comparator includes a first amplifier and said second stage comparator includes second and third amplifiers, and said first, second and third amplifiers are incorporated into a QUAD comparator which is mounted on a board.

14. A fan slowdown indicator circuit, comprising:

a first stage comparator including a pulse detector which detects a level of pulses from a fan, wherein said first stage comparator monitors back pulses of a turning DC motor of the fan using a pulsed isolation resistor, an input AC coupling capacitor and a pulse detector comparator; and a second stage comparator which sets the pulse from the fan at which an indicator indicates a slow pulse rate of the fan and which actuates the indicator, wherein said second stage comparator causes the indicator to have an indicator signal whose size is inversely proportional to the speed of the fan.

15. The circuit of claim 14 wherein said pulsed isolation resistor prevents a power supply, which supplies power to said first and second comparators and the fan, from filtering out the pulses from the fan, said input AC coupling capacitor blocks any DC level of the pulses, and said pulse detector comparator causes additional power to be generated through said second stage comparator to actuate the indicator when a slow pulse rate of the fan is detected.

16. A fan slowdown indicator circuit, comprising:

a first stage comparator including a pulse detector for detecting a level of pulses from a fan, wherein said first stage comparator monitors back pulses of a turning DC motor of a fan using a pulsed isolation resistor, an input AC coupling capacitor and a pulse detector comparator; and a second stage comparator including setting means for setting the pulse from the fan at which an indicator indicates a slow pulse rate of the fan and which actuates the indicator.

17. A fan slowdown indicator circuit, comprising:

a first stage comparator including a pulse detector for detecting a level of pulses from a fan; and a second stage comparator including setting means for setting the pulse from the fan at which an indicator indicates a slow pulse rate of the fan and which actuates the indicator, wherein said second stage comparator causes the indicator to have an indicator signal whose size is inversely proportional to the speed of the fan.

18. A fan slowdown indicator circuit, comprising:

a first stage comparator including a pulse detector for detecting a level of pulses from a fan, wherein said first stage comparator AC couples pulses from the fan and then amplifies them; and a second stage comparator including setting means for setting the pulse from the fan at which an indicator indicates a slow pulse rate of the fan and for actuating the indicator.

* * * * *